US006183626B1

(12) United States Patent
Lenglet et al.

(10) Patent No.: US 6,183,626 B1
(45) Date of Patent: Feb. 6, 2001

(54) METHOD AND DEVICE FOR STEAM CRACKING COMPRISING THE INJECTION OF PARTICLES UPSTREAM OF A SECONDARY QUENCHING EXCHANGER

(75) Inventors: Eric Lenglet, La Celle Saint Cloud; Jean-Pierre Burzynski, Sainte-Foy-les Lyon; Gérard Courteheuse, Rueil-Malmaison; Roland Huin, Montesson la Borde; Yves Gougne, Givors, all of (FR)

(73) Assignee: Institute Francais du Petrole, Rueil Malmaison Cedex (FR)

( * ) Notice: Under 35 U.S.C. 154(b), the term of this patent shall be extended for 0 days.

(21) Appl. No.: 09/202,925

(22) PCT Filed: Jun. 24, 1997

(86) PCT No.: PCT/FR97/01117

§ 371 Date: Mar. 12, 1999

§ 102(e) Date: Mar. 12, 1999

(87) PCT Pub. No.: WO97/49783

PCT Pub. Date: Dec. 31, 1997

(30) Foreign Application Priority Data

Jun. 25, 1996 (FR) ..... 96 07870

(51) Int. Cl.[7] ..... C10G 9/12

(52) U.S. Cl. ..... 208/48 R; 208/489; 208/130; 585/648

(58) Field of Search ..... 208/48 Q, 48 R, 208/130, 131, 132, 126, 127; 585/648, 650; 134/8, 22.11

(56) References Cited

FOREIGN PATENT DOCUMENTS

| | | |
|---|---|---|
| 0031609 | 7/1981 | (EP) . |
| 0272378 | 6/1988 | (EP) . |
| 2647804 | 12/1990 | (FR) . |
| 9012851 | 11/1990 | (WO) . |
| 9620255 | 7/1996 | (WO) . |

*Primary Examiner*—Bekir L. Yildirim
(74) *Attorney, Agent, or Firm*—Millen, White, Zelano & Branigan, P.C.

(57) ABSTRACT

A steam-cracking process includes the injection, at at least one point upstream from a secondary quenching indirect exchanger (4*b*), of particles with a mean size of between 0.02 and 4 mm, at a velocity speed in the exchanger of 20 to 180 m/s, in sufficient quantity to limit the rise in the output temperature of the effluents from the exchanger to a value that is less than 100° C. per month. At least 70% by weight of the quantity of injected particles is introduced downstream from primary quenching exchangers (4*a*) and upstream from the inlet to the secondary quenching exchanger. At intervals, decoking of the pyrolysis pipes and primary quenching exchangers is carried out in the presence of air.

11 Claims, 1 Drawing Sheet

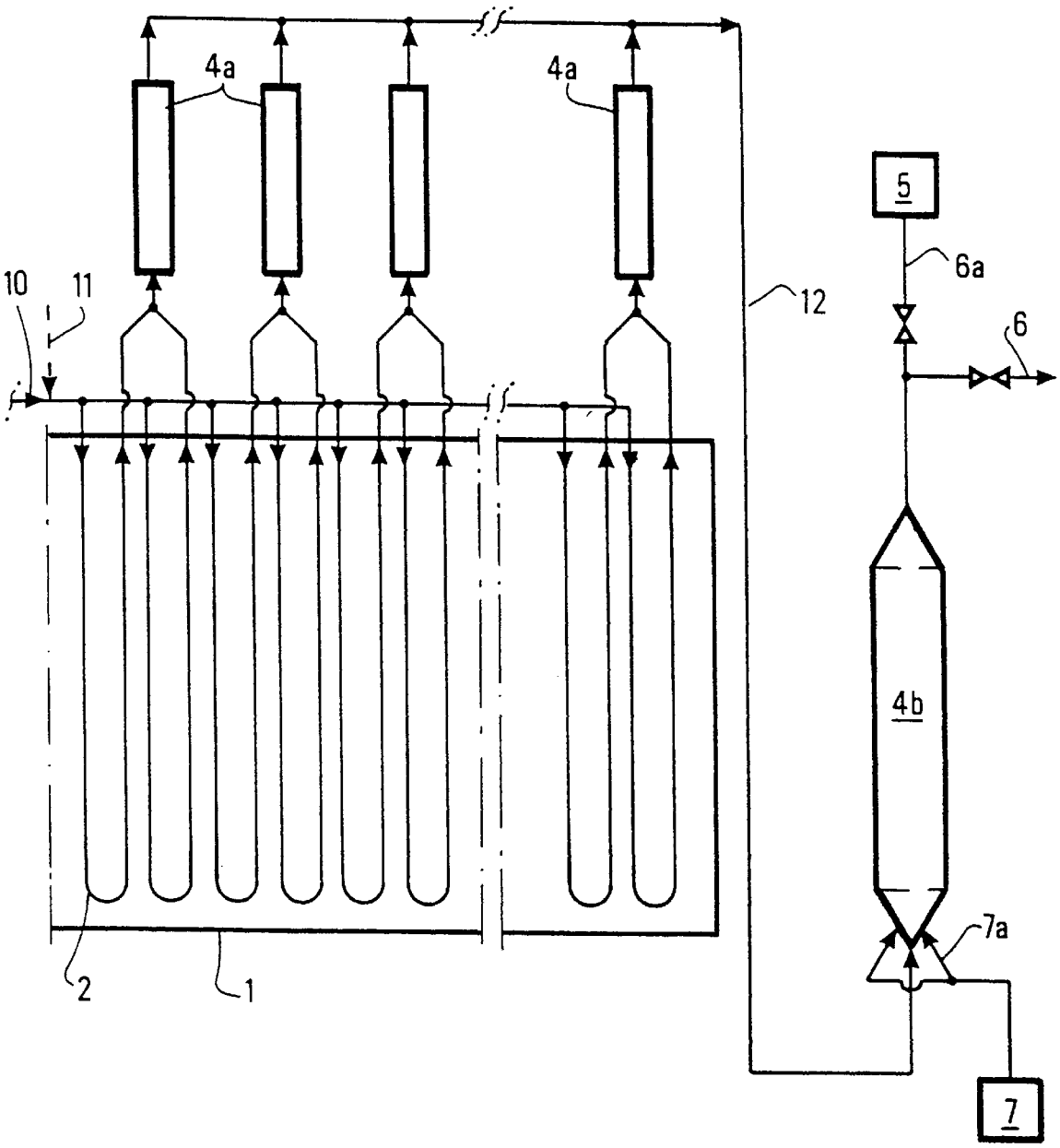
4a
4a
5
6a
6
10
11
12
4b
7a
2
1
7

METHOD AND DEVICE FOR STEAM CRACKING COMPRISING THE INJECTION OF PARTICLES UPSTREAM OF A SECONDARY QUENCHING EXCHANGER

SUMMARY OF THE INVENTION

The invention relates to a process for flexible steam cracking of hydrocarbons, i.e., a process that is compatible with a wide variety of feedstocks to be cracked and a wide variety of operating conditions. It also relates to a process for decoking of the steam-cracking unit.

BACKGROUND OF THE INVENTION

The technological background is illustrated by patent applications WO-A-90.12851, WO-A-96.20255, EP-A-0 036 151, EP-A-0 036 609, EP-A-0 272 378, and FR-A-2 647 804.

The steam-cracking process is the basic process of the petrochemical industry and consists in cracking a feedstock of hydrocarbons and water vapor at high temperature and then abruptly cooling it. The main operating problem arises from the deposition of carbon-containing products on the inner walls of the unit. These deposits, which consist of coke or heavy pyrolysis tars that are condensed and more or less agglomerated, limit heat transfer in the cracking zone (in a pyrolysis pipe coil) and the indirect quenching zone (effluent quenching exchanger), thus requiring frequent shutdowns to decoke the unit.

The standard cycle periods (operation between two complete chemical decokings of the cracking zone, with air and/or with vapor) are either set (scheduled shutdowns) or variable, depending on the coking of the unit, and generally are spread between 3 weeks and 12 weeks for feedstocks such as naphtha and liquefied petroleum gases.

It is known to one skilled in the art that the coking problems that are encountered during the cracking of heavy feedstocks (atmospheric gas oils, heavy gas oils, distillates under vacuum) are much more serious than those that are encountered on standard feedstocks, such as naphtha.

Consequently, these feedstocks cannot be cracked in standard steam-crackers that are designed for cracking naphtha, and cannot be cracked according to the known processes that in special furnaces typically comprise direct quenching (with pyrolysis oil) of the steam-cracking effluents; this considerably impairs the energy balance of the unit (no high-pressure vapor production).

The known processes that make it possible to have flexibility with respect to the heavy feedstocks are therefore incompatible with the existing steam-cracking units on standard feedstocks, and they have a greatly degraded energy balance.

Furthermore, in the case of relatively light feedstocks, there is a tendency also to use as steam-cracking feedstocks poor-quality naphthas such as $C_4$, $C_5$ recycling fractions, thermal cracking gasolines, or the core of fraction of catalytic cracking (FCC). These olefinic feedstocks lead to significant coking problems, in particular with a high degree of severity.

Furthermore, the applicants have already proposed (EP-A-419 643, EP-A-425 633 and EP-A 447 527) a process for in-service decoking of steam-cracking units, by injecting erosive solid particles in order to solve coking problems and to obtain continuous or approximately continuous steam cracking (for example, cycle periods on the order of 1 year).

For a given feedstock, this process consists in allowing a layer of coke to form and mature on the inner walls of the cracking coil and then injecting erosive particles (for example, mineral particles that are hard, with a diameter of less than 150 micrometers, spherical or angular) in sufficient quantity to stabilize approximately the coking state of the pipes without totally eliminating the pre-layer of coke, which plays a protective role for these pipes.

This process requires good knowledge of the coking speeds of the feedstock that is being considered and a coil design such that there is a certain correspondence between the local coking speeds, which are related to the progress of cracking along the coil, and the intensity of erosion, which is related to the speed profile along the coil and to the nature of the erosive particles. With, on the one hand, simulations of coking speeds and the profile of circulation speeds in the coil and, on the other, pilot experiments, it is possible to provide for approximately continuous steam-cracking conditions of the feedstock under study.

It can be ensured that there is very little if any erosion of the pipes, and erosion can be monitored by the analysis of metal traces (iron, chromium, nickel) in the powders that are recovered.

The applicants have therefore sought to improve this process, which can be applied to the cracking of a given feedstock, in the case of a flexible furnace that can successively process a large number of different feedstocks, with variable operating conditions (flow rate, degree of dilution, degree of severity of cracking).

Pilot tests have been carried out and have provided several unexpected results:

It was actually found that the initial coking of the coil (at the beginning of the cycle) could vary to a very significant extent depending on the feedstock, including for feedstocks that are slightly different in terms of chemical composition but are of different origins. It has not been possible to explain this completely, and it may be due to impurities that are present in the feedstock.

Furthermore, the effectiveness of decoking has proven to depend in particular on the feedstocks and operating conditions (different nature of the coke). In particular, it was found that at the beginning of the reaction zone the light feedstocks: $C_3$, $C_4$, light naphtha, produce a much more fragile catalytic coke (by 5 to 10 times) than the asymptotic coke that predominates in the middle and at the end of the reaction zone. For these feedstocks it is therefore desirable to limit the circulation speed in this zone to maintain a protective coke layer and/or to avoid risks of erosion of the cracking pipes.

Thus, it has not been possible to predetermine the quantities of particles that are suitable for each feedstock and each operating condition without preliminary tests, and such tests cannot be carried out in the case of a flexible industrial furnace. In addition, with regard to the prevention of erosion risks, the geometry of the cracking reactor that is suitable for a given feedstock is not the same as that which is suitable for another feedstock that has a degree of dilution and a type of coke that are different, for which the appropriate profile of circulation speeds will be different.

Finally, because of the difficulties in obtaining reliable and specific measurements of skin temperatures of the pipes by optical pyrometry, as well as due to fluctuations of these temperatures and the loss of load under the variable operating conditions, it is very difficult to monitor effectively the state of coking of the pipe without resorting frequently to a constant reference state, which cannot be done for a flexible industrial furnace, and thus to be able to control in real time the coking of a pyrolysis coil.

The process has therefore proven difficult to use industrially under variable operating conditions, and it has not been possible to keep any trace of erosion from arising in cracking pipes for all the pilot tests.

It thus appeared that the continuous steam-cracking process could not be adapted in the case of a flexible furnace and should be reserved solely for cracking of identical or similar feedstocks under relatively stable conditions.

Furthermore, the applicants have noted that elimination of deposits in the indirect quenching exchanger could be achieved much more easily than in the pyrolysis pipes and that, even in the case of injection of particles in excess quantity, no erosion was noted.

Thus, it appeared, surprisingly enough, that the carbon-containing deposits of the quenching exchanger, in particular in the case of heavy feedstocks, were much more fragile than the coke of the cracking pipes. It was found, actually, that the brittleness, compared to the erosion by the solid particles under test, was at least 25 times greater for the coke of the quenching exchanger than for the asymptotic coke of the pyrolysis pipes.

The absence of erosion that is noted for the pipes of the exchanger themselves is explained by the fact that the circulation speed of the particles is much lower in the quenching exchanger than in the pyrolysis pipes and that their temperature is very low (approximately 330° C. as opposed to typically 1000 to 1100° C. for the pyrolysis coil). In addition, the quenching exchanger pipes are straight, without bends, which eliminates the risks of point erosion.

Furthermore, it has appeared that over a long period of time the coking speeds in the cracking pipes remain on the same order of magnitude for the heavy feedstocks (for example, gas oil) as for light feedstocks and that the true bottleneck for flexibility with respect to the heavy feedstocks lies in the excessive clogging of the indirect quenching exchanger. Thus, it has been found, in a non-obvious way, that existing naphtha steam-cracking units were also able to crack heavy feedstocks such as gas oils and distillates of suitable quality under a vacuum or olefinic feedstocks with a high degree of severity if the quick clogging of the indirect quenching exchangers could be prevented.

Likewise, for light olefinic feedstocks, such as $C_4$, $C_5$ recycling fractions or gasoline fractions of catalytic cracking with a low octane number, it was also found that the clogging of quenching exchangers was much more severe for the quenching exchangers, in particular with a high degree of severity.

Therefore a new process has been proposed, in French Patent Application No. 94/15743, a new process for flexible steam cracking that is compatible with the existing steam-cracking units which make it possible to treat various feedstocks according to variable operating conditions, without degrading the thermal balance of the units, without significant risks of erosion, and at a modest investment cost.

One of the main characteristics of this process is that the bulk of the erosive solid particles (at least 70% and up to 100%) are injected downstream from the pyrolysis pipes and upstream from the indirect quenching exchangers.

This makes it possible to limit or eliminate the technological risks of erosion of the pyrolysis pipes by minimizing or preventing the circulation of particles in these pipes, while ensuring flexible operation thanks to a decoking effect on the part of the quenching exchangers.

The application of this process to a type of modern furnaces with very short dwell times (0.07 to 0.27 second) faces technical obstacles, however: these furnaces actually contain a very large number of small-diameter pyrolysis pipes that are connected downstream to a large number of primary quenching exchangers, generally of the double-pipe type, straight or U-shaped, which are connected downstream to a very small number (generally 1 or 2) of secondary quenching exchangers, before the transfer of cooled cracked gases to the direct downstream quenching.

The application of the process according to French Patent Application No. 9415743 therefore requires that particles be injected upstream from each of the primary quenching exchangers, of which there are typically a large number (for example, 20 per furnace) and with higher input temperatures (850 to 900° C.) than in the standard steam-cracking furnaces.

The circulation speeds in these primary quenching exchangers are also very high (generally, considerably greater than 100 m/s), which increases the risks of erosion, in particular in the output bends, of which there are many.

The application of the flexible steam-cracking process is therefore complex and difficult for this type of furnace.

SUMMARY OF THE INVENTION

The object of the process according to this invention is to propose a steam-cracking process that is flexible, effective, and reliable and requires modest investment, while being suitable for modern furnaces that comprise a large number of primary quenching exchangers.

For this purpose, a hydrocarbon-containing feedstock steam-cracking process in a unit that comprises at least one steam-cracking furnace that comprises a number of pyrolysis pipes that are connected by a number of pipes to means for indirect quenching of the effluents of the pyrolysis pipes is proposed, whereby said means comprise at least one multitube, secondary quenching exchanger that is connected upstream to a number of primary quenching exchangers and downstream to direct quenching means and fractionating means, whereby the process comprises the injection of erosive solid particles to eliminate at least a portion of the carbon-containing deposits that are located on the inner walls of the unit, whereby the process is characterized in that:

a) advantageously while the steam-cracking unit is in operation, erosive solid particles with a mean diameter of between 0.02 and 4 mm are injected at at least one point in the unit that is located downstream from said primary quenching exchangers and upstream from the secondary quenching exchanger, whereby the particles that circulate in the secondary quenching exchanger are then conveyed by a carrier gas whose mean speed is advantageously between 20 and 180 m/s and preferably 40 to 130 m/s, mean quantities Q of erosive solid particles that are injected downstream from the primary quenching exchangers and upstream from the secondary quenching exchanger that represent at least 70% by weight of the overall mean quantities [Q+q] that are injected upstream from the exchanger, whereby q represents the mean quantities of erosive particles that are injected upstream from the primary exchangers, Whereby overall mean quantities [Q+q] of injected erosive particles are determined so as to limit the rise in output temperature of the secondary quenching exchanger effluents to a value that is less than 100° C. per month and preferably less than 50° C. per month and to make it possible to operate the steam-cracking furnace for at least 6 months and preferably at least 12 months, and more particularly at least 18 months, without hydraulic decoking of the indirect quenching means.

b. At intervals that do not exceed 8 months and preferably between 0.5 and 4 months, in the primary quenching exchangers and the pyrolysis pipes upstream, decoking conditions created by circulating a gas that contains air for decoking these pipes and at least partial decoking of the primary exchangers.

According to a characteristic variant of the process, during the steam-cracking phases, mineral erosive particles, preferably at least partially angular, are injected downstream from the primary exchangers and upstream from the secondary exchanger, at fixed or variable intervals between 0.3 and 72 hours, and at least the bulk of the particles are separated downstream from the secondary exchanger, whereby the quantities of injected particles are sufficient to limit the rise in temperature of the effluents of the exchanger to a value that does not exceed 50° C. per month.

According to another characteristic variant, during the steam-cracking phases, erosive solid coke particles are injected downstream from the primary quenching exchangers and upstream from the secondary exchanger, whereby downstream from the secondary exchanger these particles are conveyed without separation to means that are downstream from direct quenching and fractionating means, whereby the injected quantities are sufficient to limit the rise in temperature of the effluents in the exchanger to a value that does not exceed 50° C. per month.

According to another characteristic variant, at least 90% by weight or even 100% of the quantities of injected particles are thus injected during the decoking phases with air and/or with vapor and are evacuated via a decoking line.

In a preferred way, all of the erosive solid particles that are injected upstream from the secondary exchanger are injected downstream from the primary exchangers.

The invention also proposes a steam-cracking unit that comprises at least one steam-cracking furnace that comprises a cracking zone that comprises a number of pyrolysis pipes that are connected downstream by a number of transfer pipes to a number of primary quenching exchangers, whereby these primary quenching exchangers are connected downstream to at least one secondary quenching exchanger, which itself is connected downstream to direct quenching means and fractionating means, characterized in that it comprises:

means for metering and injection of erosive solid particles, with said means being connected to at least one point in the unit that is located downstream from the primary exchangers and upstream from the secondary exchanger, for the introduction downstream of these exchangers of at least 70% by weight of the solid particles that are introduced upstream from the secondary exchanger, means for measuring the temperature of the effluent from the exchanger to make it possible to monitor its degree of clogging, and means for decoking in the presence of air, with said means being connected to pyrolysis pipes that are upstream from them, in order to create decoking conditions in the pyrolysis pipes and the primary exchangers.

Thus, the process according to the invention is a mixed decoking process.

The pyrolysis pipes and the primary quenching exchangers are basically decoked with air (generally mixed with water vapor), with little or no circulation of erosive solid particles to preclude any risk of erosion.

On the contrary, the decoking of the secondary quenching exchanger or exchangers includes elimination of coke by erosion (it is also possible to have partial decoking with air during the phases of decoking of the pyrolysis pipes and primary exchangers).

The process, which is therefore distinguished from the process that calls for injection of particles upstream from all of the quenching exchangers, is based on the following analysis and technical results:

In the primary quenching exchangers, the cracked gases are cooled only partially (for example from 850° C. to 500/550° C.). The high temperatures of the gases tend to limit the condensation of heavy precursor polyaromatics of coke and also to increase the skin temperatures at the gas/coked wall interface of the quenching exchanger.

As a result, the coking of these exchangers remains relatively moderate, even with heavy feedstocks or coking feedstocks. In addition, the acceptable output temperature of these exchangers is high (for example 550/620° C.). They can therefore operate with long cycle times. Conversely, the secondary quenching exchangers operate with much lower temperatures (360 to 450° C. at the output), which promotes the condensation of polyaromatic compounds and much faster coking, in particular with heavy feedstocks or coking feedstocks.

If the decoking aspect is now considered (by slow oxidation of coke in the presence of air), the phenomenon is reversed: the high temperatures promote the decoking of the primary exchangers, whereas the low temperatures very strongly limit the possibilities of decoking with air of the secondary exchangers.

The process according to the invention, which therefore comprises decoking basically with air of the primary exchangers and at least partially erosive decoking of the secondary quenching exchangers, is thus very well suited to these technical results.

The advantage of this process compared to the one described previously (injection upstream from all of the quenching exchangers) is very significant for the type of furnaces that are being considered:

It typically requires only one particle injection system for each secondary quenching exchanger, instead of 10 or 20 injection systems in the primary exchangers that are located upstream.

In addition, injection is easier to carry out, because it is produced in a zone with a lower temperature.

The advantage of simplicity and therefore reliability and investment cost is very significant.

The process remains very effective under flexible conditions, with a modest investment and very low technological risks.

Other provisions of this process or unit variants of the process described previously remain applicable to the process and to the unit according to the invention. In this connection, it is possible to refer to French Patent Applications Nos. 94/15743, 94/15744, 94/17545, 94/15746 and 94/15747.

Reference is now made to FIG. 1, which shows a portion of a steam-cracking furnace (1) according to the invention. A number of pyrolysis pipes (2) that are supplied with a hydrocarbon-containing feedstock and water vapor through lines (10) and (11) and are located in the radiation zone of the furnace are shown. They are connected downstream by a number of transfer pipes (3) to a number of primary quenching exchangers (4*a*). Said exchangers are connected downstream to a secondary quenching exchanger (4*b*) by a line (12). Downstream from this exchanger, the effluents are sent to direct quenching and fractionating means (5) via a line (6*a*), or else are evacuated during the phases of decoking (air and/or vapor) via decoking line (6).

The furnace also comprises means (7, 7*a*) for metering and injection of erosive solid particles that are directly upstream from secondary exchanger (4*b*).

This furnace operates in a standard way with cracking phases and decoking phases with air and/or with water vapor, after the injection of hydrocarbons has been halted.

When the heavy feedstocks or coking feedstocks (for example olefinic feedstocks) are cracked, the most acute coking problems arise in secondary exchanger (4*b*), which is furthermore very poorly decoked during the phase of decoking with air.

According to the process, particles are injected continuously or preferably by means (7 and 7*a*) to reduce or eliminate the coking problems of exchanger (4*b*).

It is possible to inject the particles during operating phases of the furnace, i.e., either during the steam-cracking periods or during the decoking periods (with air, with vapor or with air/vapor mixtures).

The particles can be mineral (for example corundum) and can consist of coke, and optionally metallic coke.

If the particles do not consist of coke, it will be necessary either to collect them downstream from exchanger (4*b*) or to inject them only during decoking phases so that they are evacuated via decoking line (6).

Means of separation, not shown, such as a cyclone, can be installed downstream from exchanger (4*b*) or on decoking line (6).

Various process or unit variants such as injection under vapor, injection with a momentary increase of the gas flow rate, means for recycling particles, injection of various chemical additives, etc., are described in the patent applications that are cited above and can be used according to the invention.

The unit that is described in FIG. 1 can also comprise means for injecting limited quantities of erosive particles (less than 30% by weight on average per year) upstream from pyrolysis pipes (2) or between pipes (2) and primary exchangers (4*a*), but the preferred variant consists in injecting all of the particles directly upstream from exchanger (4*b*).

EXAMPLE

Consider a steam-cracking furnace that comprises 40 U-shaped pyrolysis pipes (2) (pins) that are connected to 20 primary quenching exchangers (4*a*) of the double-pipe type that are connected to two secondary quenching exchangers (4*b*).

The primary exchangers cool the cracked gases to a temperature that is between 480 and 620° C., whereby the secondary exchangers lower their temperature between 360 and 450° C.

On naphtha with a medium degree of severity, the cycle period between two decokings with air is typically 2 months, and the period between two hydraulic decokings of exchangers is 6 to 8 months.

When coking feedstocks: mediocre-grade naphthas with a very high degree of severity, olefinic recycling fractions, light or heavy gas oil are also cracked, the cycle periods can drop significantly below three weeks, and hydraulic decoking of the exchangers may be necessary at intervals of 3 to 4 months or less.

According to the process, erosive particles, for example corundum, are injected directly upstream from two exchangers (4*b*) in sufficient quantity to limit the rise in the output temperature of exchangers (4*b*) to 20° C. per month at most, and the air decoking periods are extended: 36 to 48 hours, as opposed to the 15 to 24 hours that are strictly necessary for decoking pyrolysis pipes, to decoke the primary exchangers thoroughly.

According to this application of the process, it is possible, with coking feedstocks, to increase the cycle periods considerably beyond 1 month, and almost to eliminate hydraulic decoking; this eliminates a major ancillary system.

This can be done simply, reliably, and economically by injecting the particles directly upstream from just two exchangers (4*b*), instead of 20 primary exchangers (4*a*). In addition, it is not necessary to reinforce the bends at the output of exchangers (4*a*).

The invention therefore provides a very significant improvement in the case of furnaces that comprise a large number of primary quenching exchangers.

What is claimed is:

1. A process for steam cracking hydrocarbon-containing feedstocks in a unit that comprises at least one steam-cracking furnace that comprises a number of pyrolysis pipes that are connected by a number of pipes to means for indirect quenching of the effluents from the pyrolysis pipes, whereby said means comprise at least one multitube, secondary quenching exchanger (4*b*) that is connected upstream to a number of primary quenching exchangers (4*a*) and downstream to direct quenching means and fractionating means (5), whereby the process comprises the injection of erosive solid particles to eliminate at least a portion of the carbon-containing deposits that are located on the inner walls of the unit, whereby the process is characterized in that:

a) erosive solid particles with a mean diameter of between 0.02 and 4 mm are injected at at least one point in the unit that is located downstream from said primary quenching exchangers (4*a*) and upstream from secondary quenching exchanger (4*b*), whereby the particles that circulate in the secondary quenching exchanger are then conveyed by a carrier gas, mean quantities Q of erosive solid particles that are injected downstream from primary quenching exchangers (4*a*) and upstream from secondary quenching exchanger (4*b*) that represent at least 70% by weight of the overall mean quantities [Q+q] that are injected upstream from exchanger (4*b*), whereby q represents the mean quantities of erosive particles that are injected upstream from primary exchangers (4*a*), With overall mean quantities [Q+q] of injected erosive particles being determined to limit the rise in output temperature of the secondary quenching exchanger effluents to a value that is less than 100° C. per month and to make it possible to operate the steam-cracking furnace for at least 6 months, without hydraulic decoking of the indirect quenching means;

b. decoking conditions are established discontinuously at intervals that do not exceed 8 months, in primary quenching exchangers (4*a*) and the pyrolysis pipes upstream, by circulating a gas that contains air for decoking these pipes and at least partial decoking of primary exchangers (4*a*).

2. A process according to claim (1), wherein during the steam-cracking phases, mineral erosive particles are injected downstream from primary exchangers (4*a*) and upstream from secondary exchanger (4*b*) at fixed or variable intervals of between 0.3 and 72 hours, and at least the bulk of the particles are separated downstream from exchanger (4*b*), whereby the quantities of injected particles are sufficient to limit the rise in temperature of the effluents of exchanger (4*b*) to a value that does not exceed 50° C. per month.

3. A process according to claim (1), wherein during the steam-cracking phases, erosive solid coke particles are injected downstream from primary quenching exchangers (4*a*) and upstream from secondary exchanger (4*b*), whereby downstream from secondary exchanger (4*b*) these particles are conveyed without separation to means that are downstream from direct quenching and fractionating means (5), whereby the injected quantities are sufficient to limit the rise in temperature of the effluents in exchanger (4*b*) to a value that does not exceed 50° C. per month.

4. A process according to claim 1, wherein at least 90% by weight of the quantities of injected particles are thus injected during the decoking phases with air and/or with vapor and are evacuated via a decoking line (6).

5. A process according to claim 1, wherein all of the erosive solid particles that are injected upstream from secondary exchanger (4*b*) are injected downstream from primary exchangers (4*a*).

6. A steam-cracking unit that comprises at least one steam-cracking furnace (1) that comprises a number of pyrolysis pipes (2) that are connected downstream by a number of transfer pipes (3) to a number of primary quenching exchangers (4*a*), whereby said primary quenching exchangers are connected downstream to at least one secondary quenching exchanger (4*b*), which itself is connected downstream to direct quenching means and fractionating means (5), characterized in that it comprises:

means (7) for metering and injection of erosive solid particles, with said means being connected to at least one point in the unit that is located downstream from primary exchangers (4*a*) and upstream from secondary exchanger (4*b*), for the introduction downstream from these exchangers (4*a*) of at least 70% by weight of the solid particles that are introduced upstream from secondary exchanger (4*b*), means for measuring the temperature of the effluent from exchanger (4*b*) to make it possible to monitor its degree of clogging, and means for decoking in the presence of air, with said means being connected to pyrolysis pipes (2) that are upstream from them for setting decoking conditions in pyrolysis pipes (2) and primary exchangers (4*a*).

7. A process according to claim 1, wherein said carrier gas has a mean speed of between 20 and 180 ms.

8. A process according to claim 1, wherein the rise in output temperature of the secondary quenching exchanger effluents is less than 50° C. per month, making it possible to operate the steam-cracking furnace for at least 18 months.

9. A process according to claim 1, wherein in step (b) the decoking conditions are established discontinuously at intervals between 0.5 and 4 months.

10. A process according to claim 2, wherein said mineral erosive particles are at least partially angular.

11. A process according to claim 1, wherein said carrier gas has a mean speed of 40 to 130 ms.

* * * * *